US008684889B1

(12) United States Patent
Berrisford

(10) Patent No.: US 8,684,889 B1
(45) Date of Patent: Apr. 1, 2014

(54) REMOVABLE HANDLE

(76) Inventor: Matthew Berrisford, Westerville, OH (US)

( * ) Notice: Subject to any disclaimer, the term of this patent is extended or adjusted under 35 U.S.C. 154(b) by 268 days.

(21) Appl. No.: 13/097,804

(22) Filed: Apr. 29, 2011

(51) Int. Cl.
*A63B 21/00* (2006.01)

(52) U.S. Cl.
USPC ..... 482/49; 482/126; 482/107; 482/108

(58) Field of Classification Search
USPC ..... 482/49, 121, 126, 148, 106, 107, 108, 482/48; D21/692
See application file for complete search history.

(56) References Cited

U.S. PATENT DOCUMENTS 1,646,158 A * 10/1927 McWhirter ..... 482/24
6,012,752 A * 1/2000 Douglas ..... 294/110.1
7,328,932 B2 * 2/2008 Plavetich et al. ..... 296/146.11
2005/0187082 A1 * 8/2005 Bowser ..... 482/123

OTHER PUBLICATIONS

Kettlebell Handles, Kettlebell Handles, Apr. 29, 2011, 2 pages, http:// kettlebellhandles.info/, KettlebellHandles.info.
Kettlebell Handles, Make Adjustable Kettlebells Using Standard Weight Plates, Apr. 29, 2011, 2 pages, http:// kettlebellhandles.info/ make-adjustable-kettlebells-standard-weight-plates, KettlebellHandles.info.

* cited by examiner

*Primary Examiner* — Jerome W Donnelly
(74) *Attorney, Agent, or Firm* — Standley Law Group LLP

(57) ABSTRACT

A handle for removable attachment to a dumbbell handle including a grip portion and a base portion is provided herein. The grip portion including side grips and top grip resembling a traditional kettlebell handle. An attachment device associated with the handle for attachment of the handle to a dumbbell handle.

3 Claims, 5 Drawing Sheets

REMOVABLE HANDLE

TECHNICAL FIELD

Exemplary embodiments of the present invention involve a handle for exercise equipment. More particularly, exemplary embodiments of the present invention relate to a kettlebell handle removably attached to a traditional dumbbell in order for the dumbbell to function as a kettlebell.

BACKGROUND

Weight training is a common type of strength training of developing strength and size of skeletal muscles. Strength training uses the force of gravity, in the form of weight bars, dumbbells or weight stacks, to oppose the force generated by muscles through concentric or eccentric contraction. Weight training uses a variety of specialized equipment to target specific muscle groups and types of movement.

One type of specialized equipment for strength training is the kettlebell. Typically, kettlebells are cast iron weights used to perform ballistic exercises that combine cardiovascular, strength and flexibility training. Unlike traditional dumbbells, the kettlebell's mass is extended beyond the hand. By their nature, typical kettlebell exercises build strength and endurance, particularly in the lower back, legs, and shoulders, and increase grip strength. The basic movements, such as the swing, snatch, and the clean and jerk, engage the entire body at once, and in a way that mimics real world activities such as shoveling or farm work.

Although beneficial, traditional kettlebells have several drawbacks. The thick handles of a traditional kettlebell make it difficult for users to grip during pulling movements. Traditional kettlebells made of cast iron are expensive and lack adjustability. Adjustable kettlebells have been developed to combat some of the drawbacks of traditional kettlebells, but even the adjustable kettlebells present the user with several problems. Adjustable kettlebells are expensive and have high shipping costs due to their weight. In addition, it is time consuming to adjust the weight of the adjustable kettlebell. Therefore, there is a clear need for an affordable device that provides users with the benefits of a traditional kettlebell.

Consequently, it can be understood that there is a need for a removable handle that immovably attaches to a conventional dumbbell to simulate the shape and weight distribution of a kettlebell. As such, exemplary embodiments of the inventive concept are designed to overcome the drawbacks of the prior art, in particular to provide a simple device for the conversion of the traditional dumbbells into a kettlebell.

SUMMARY OF THE INVENTIVE CONCEPT

Exemplary embodiments of the inventive concept are directed to a handle attachment for a dumbbell that simulates the weight distribution of a kettlebell. Exemplary embodiments of the removable handle are capable of being immovably secured to the handle of a fixed weight or adjustable dumbbell thus moving the mass of the dumbbell beyond a users hand to simulate a kettlebell.

Exemplary embodiments of the inventive handle include a grip portion and a base portion. The grip portion is formed by at least one side portion extending from the base portion and ending at the top grip. In some exemplary embodiments, the grip portion has a pair of side grips. The grip portion of the handle resembles the handle of a traditional kettlebell and has a triangular shape having an aperture therein. The diameter of the side and top grips can be adjusted to provide different exercise features. Generally, the diameter of the grips will range from about 1.25 inches to about 2.25 inches. In other exemplary embodiments, the grips may be smooth or textured/patterned. The grip portion may be constructed from plastic, wood, metal, ceramic, composite materials, and other similar materials sufficient to withstand the forces associated with weight training. The base portion is sized to fit between the weight portions of a dumbbell to which the inventive handle is to be secured.

The handle is secured to the dumbbell handle by way of an attachment device. In some exemplary embodiments, the attachment device is fixed to the base portion using an adhesive or mechanical fastener. In other exemplary embodiments, the attachment device is threaded through the aperture formed by the grip portion and the base portion. In still other exemplary embodiments, the base portion may have a passageway therein that accepts the attachment device. The attachment is then wrapped around the dumbbell handle to immovably secure the dumbbell to the inventive handle. The attachment device may be a mechanical fastener, such as a ratchet strap, or a substantially non-stretchable nylon hook and loop cinch strap. Although one of skill in the art would appreciate that other attachment devices may be used.

Additional features may also be present to assist in preventing movement of the inventive handle and dumbbell relative to one another. The base portion may have a contact surface interfacing with the dumbbell handle. In some exemplary embodiments, the contact surface may be textured/patterned to reduce slippage. In still other exemplary embodiments, the contact surface may be curved/contoured to compliment the curvature or shape of the dumbbell handle. In still other exemplary embodiments, a pad may be interposed between the contact surface and the dumbbell handle. The pad may be held in place by the squeezing force applied by the attachment device or affixed to the contact surface. In embodiments wherein the pad is affixed to the contact surface, the pad may be held in place by adhesives or mechanical fasteners. Like the contact surface, the pad may be curved/contoured to provide a better engagement between the inventive handle and the dumbbell handle. Like the inventive handle, the pad may be formed from a variety of materials such as plastics, rubbers, gels, ceramics, composites, metal, wood, and any other material that having sufficient strength to withstand the forces associated with weight training.

BRIEF DESCRIPTION OF THE DRAWINGS

In addition to the features mentioned above, other aspects of the inventive concept will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
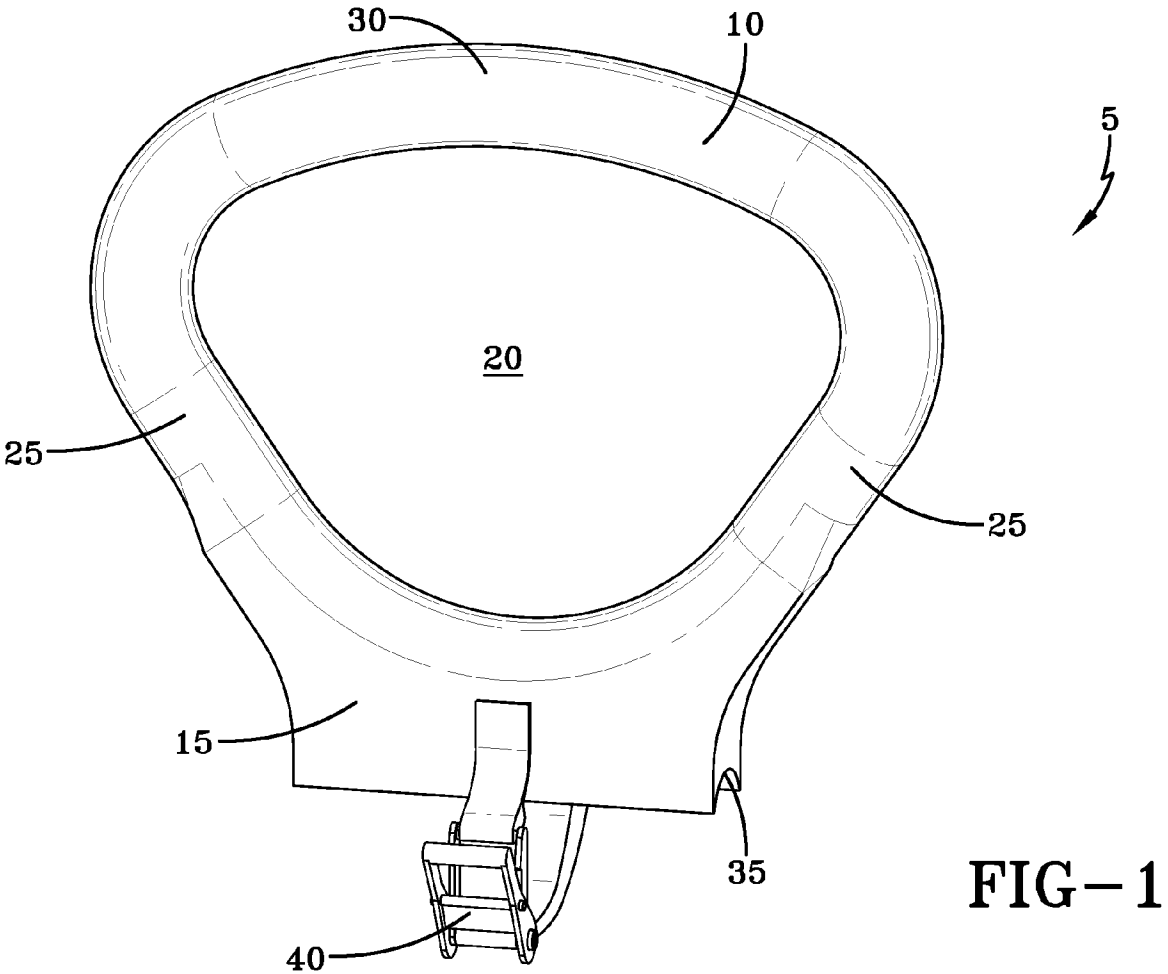
FIG. 1 is a front perspective view of an exemplary embodiment of the inventive concept.

FIG. 1 illustrates an exemplary embodiment of a detachable handle 5 of the inventive concept. The handle 5 may be constructed from a number of materials including, but not limited to, metal, wood, ceramic, polymers, fiberglass, plastics, composite materials and any other materials capable of withstanding the forces associated with weightlifting. As shown in FIG. 1, the handle 5 has a grip portion 10 and a base portion 15. The grip portion 10 and the base portion 15 define an aperture 20. The grip portion 10 resembles a handle for a traditional kettlebell and includes side grips 25 and a top grip 30. The side grips 25 extend from the base portion 15 and terminate at the top grip 30; as shown in FIG. 1. The length of the side grips 25 is sufficient to allow a user to grasp each side grip 25 with one hand. Although shown with a linear axis, the side grips 25 may be curved or contoured to allow for a variety of grasping angles.

In one exemplary embodiment, the top grip 30 is fixed to the side grips 25 and has a curvilinear axis; as shown in FIG. 1. The length of the top grip 30 is sufficient to allow a user to grasp the top grip 30 with two hands in a side-by-side arrangement. In other exemplary embodiments, the top grip 30 may have a linear axis to provide a user with different grasping angles. In some exemplary embodiments, the diameter of the grips 25 and 30 may be approximately 1.25 inches. In other exemplary embodiments, the diameter of the grips 25 and 30 may be approximately 2.25 inches. In still other exemplary embodiments, the diameter of the grips 25 and 30 may be variable and range between about 1.25 inches to about 2.25 inches. The surfaces of the grips 25 and 30 may also have a variety of textures ranging from smooth to coarse to affect the grasp of the user.

Figure 2:
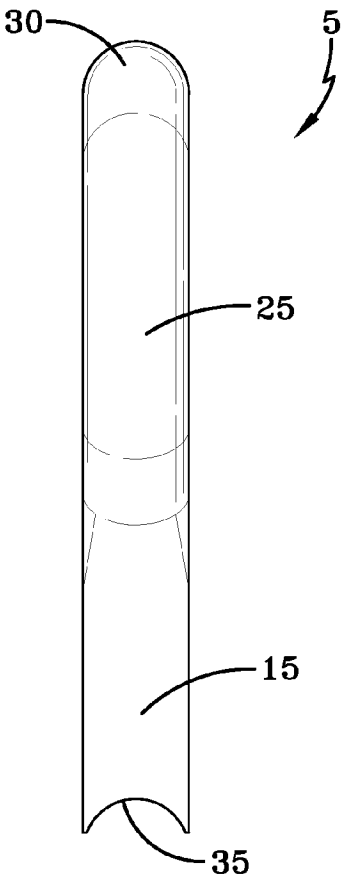
FIG. 2 is side view of an exemplary embodiment of the inventive handle, wherein the contact surface is curved.

As described above and as shown in FIG. 1, the base portion 15 has side grips 25 extending from the top portion thereof. The base portion 15 also includes a contact surface 35 opposite the side grips 25. As illustrated in FIG. 2, the contact surface 35 may be curved to match the curvature of the dumbbell to which it is to be attached. The curvature of the contact surface 35 also allows for a better contact between the contacting surface and the dumbbell. In addition, the curvature of the contact surface 35 also increases the surface areas of the contact surface 30 thus preventing movement of the handle 5 and the dumbbell relative to one another. The contacting surface 35 may also be patterned or textured to further decrease the possibility of movement between the handle 5 and the dumbbell to which is attached.

Affixed to the base portion 15 is an attachment device 40. The attachment device 40 attaches the handle 5 to a dumbbell handle. The attachment device 40 may be a mechanical device, such as a ratchet strap (as show in FIGS. 1 and 5), strong enough to immovably fix the handle 5 to the dumbbell during periods of increased force associated with swinging the handle 5 and dumbbell during exercise movements. Although the ratchet strap is shown affixed to the base portion of the handle 5 it should be understood that in other exemplary embodiments the ratchet strap may simply be threaded through the aperture 20 and around the handle of the dumbbell to be secured to the handle 5. In other exemplary embodiments, the attachment device 40 includes at least one hook and loop cinch strap (as shown in FIG. 6) used to immovably fix the handle 5 to the dumbbell handle. It should also be understood by those skilled in the art that attachment device 40 may include any mechanical or strap system capable of immovably securing the handle 5 to a dumbbell.

FIG. 2 is a side-view of an exemplary embodiment of a detachable handle 5 of the inventive concept. In the embodiment shown in FIG. 2, the contact surface 35 is curved. The curvature of the contacting surface 35 may correspond to the curvature of the dumbbell handle to which the handle 5 is to be attached. The curvature of the contact surface 35 increases the surface area of the contact surface 35 allowing for a more secure attachment between the handle 5 and the dumbbell handle. In some embodiments, the contact surface 35 may be patterned or textured to decrease the potential for movement between the handle 5 and the dumbbell.

Figure 4:
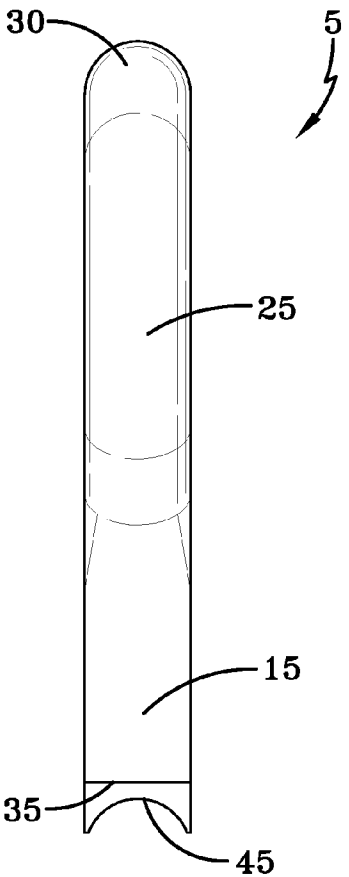
FIG. 4 is a side-view of an exemplary embodiment of the inventive handle having a non-slip pad attached to a flat contact surface.
Figure 3:
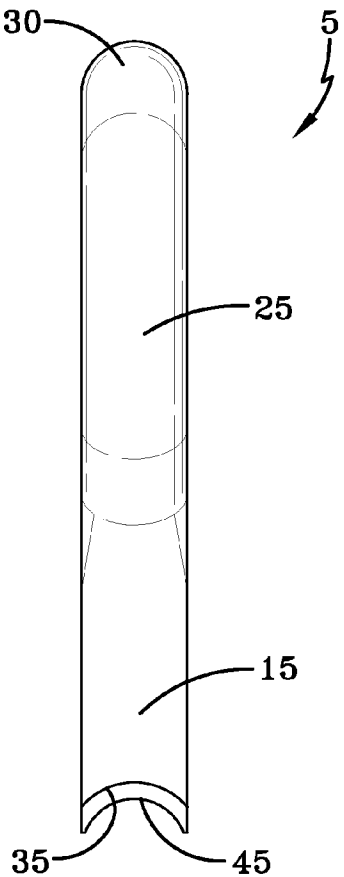
FIG. 3 is a side-view of an exemplary embodiment of the inventive handle having a non-slip pad attached to a curved contact surface.

As shown in FIGS. 3 and 4, other exemplary embodiments of the handle 5 have a pad 45 interposed between the contact surface 35 and the dumbbell. In some exemplary embodiments, the pad 45 may be placed between the contact surface 35 and the dumbbell and held in place by the squeezing force applied by the attachment device 40. In other exemplary embodiments, the pad 45 may be fixed to the contact surface 35 by adhesives or mechanical fasteners. The pad 45 may be used with both a curved contact surface 35 (as shown in FIG. 3) and a flat contact surface 35 (as shown in FIG. 4). The pad 45 may be curved and contoured to provide a complimentary engagement with the handle of the dumbbell to which the handle 5 is to be attached. To provide a secure attachment of the handle 5 to the dumbbell the pad 45 may be constructed from a non-slip material, such as rubber or gel, or have a patterned or textured surface to prevent movement between the handle 5 and the dumbbell.

Figure 5:
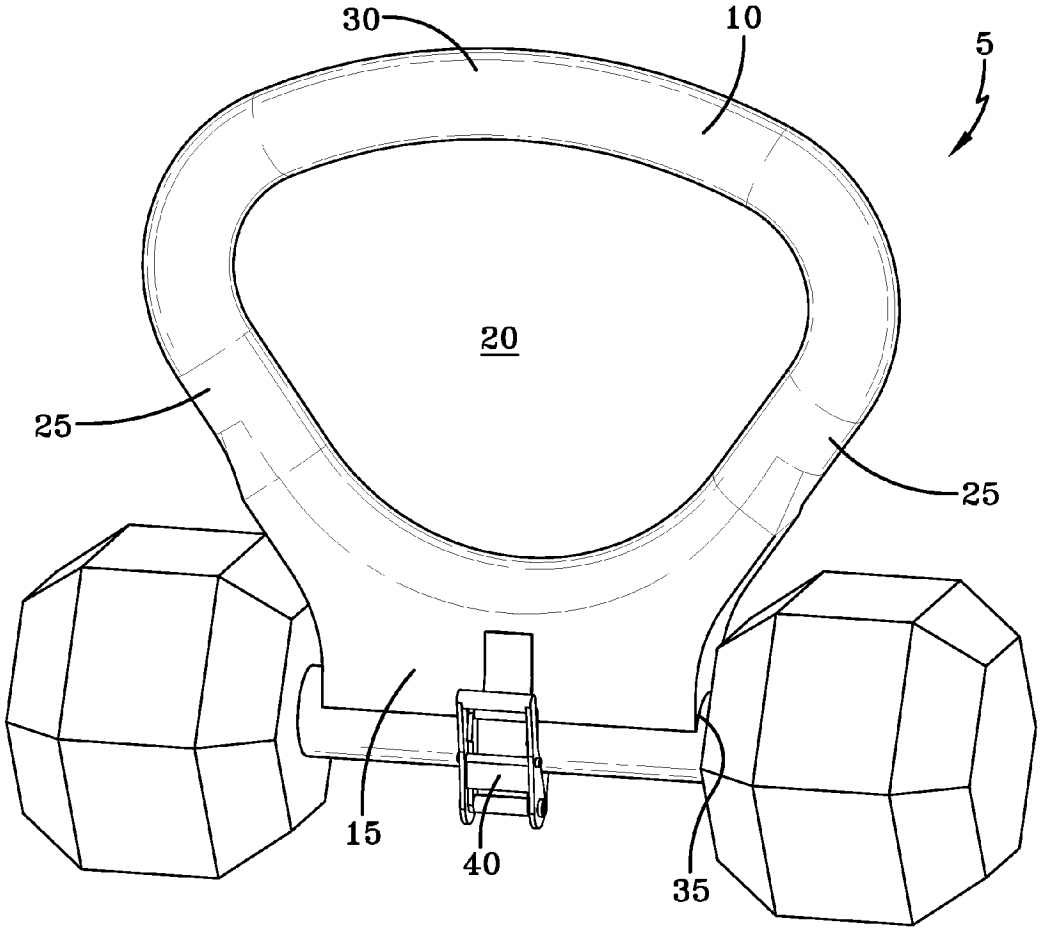
FIG. 5 is a front perspective view of an exemplary embodiment of the inventive concept attached to a fixed weight dumbbell.
Figure 6:
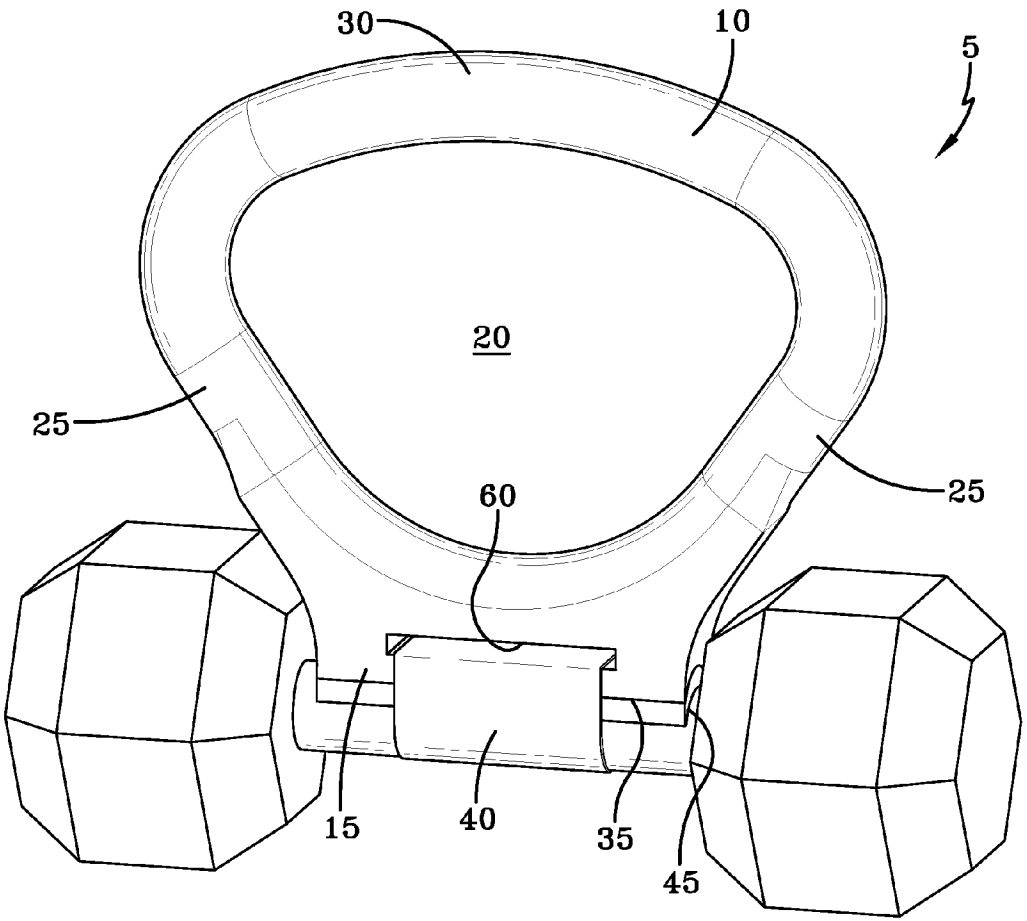
FIG. 6 is a front perspective view of another exemplary embodiment of the inventive concept attached to a fixed weight dumbbell.
Figure 7:
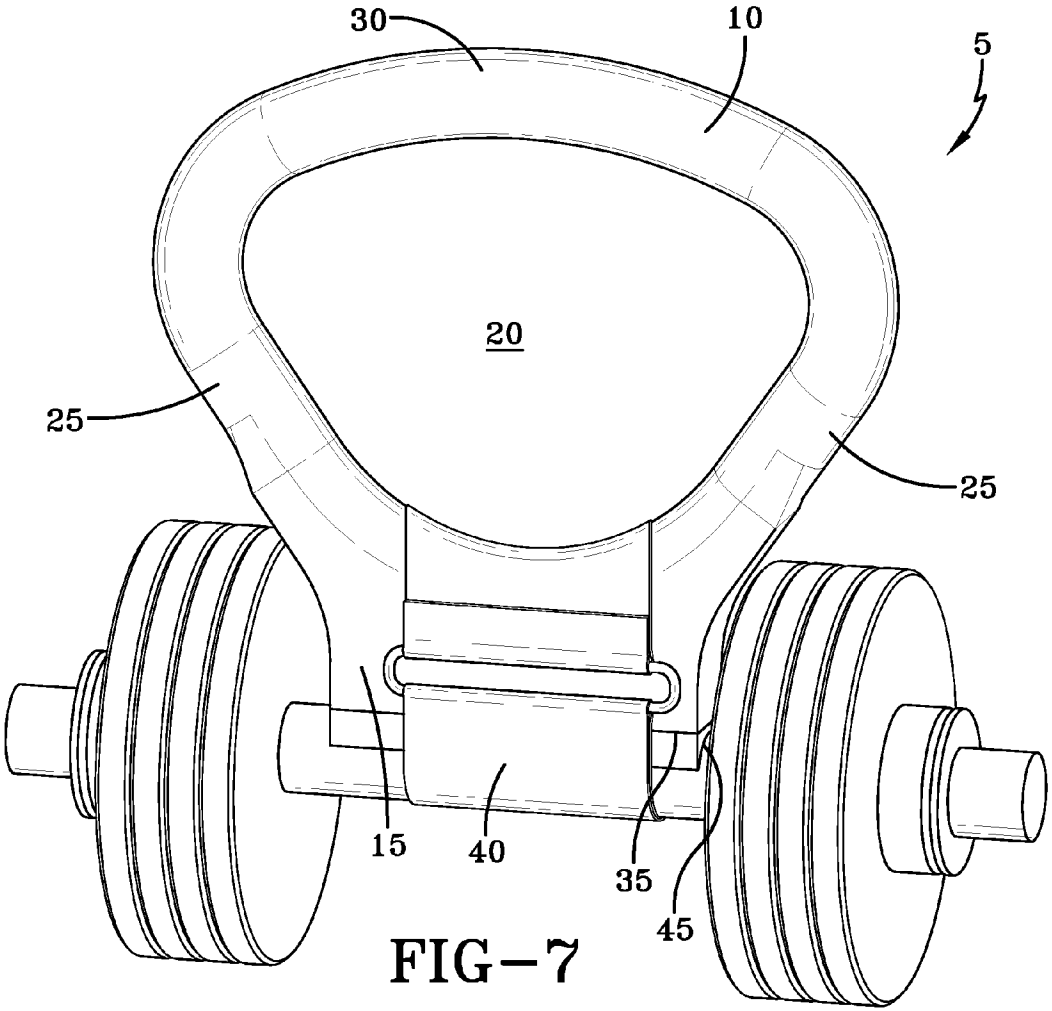
FIG. 7 is a front perspective view of another exemplary embodiment of the inventive concept attached to an adjustable dumbbell.

As shown in FIG. 5, the handle 5 may be attached to a fixed weight dumbbell. As illustrated, the attachment device 40 may be wrapped around the handle of the dumbbell to immovably secure the handle 5 to the dumbbell. In this manner, the mass of the dumbbell is extended beyond the grips 25 and 30 of the handle 5 simulating the configuration of a traditional kettlebell. Although shown attached to a fixed weight dumbbell, one of ordinary skill in the art should appreciate that the handle 5 may also be attached to an adjustable weight dumbbell (as shown in FIG. 7).

FIG. 6 illustrates another exemplary embodiment of the handle 5 attached to a dumbbell using a hook and loop cinch strap attachment device 40. As shown in FIG. 6, the base portion 15 defines a passageway 60 therein. The attachment device 40 may be threaded through the passageway 60 in the base portion 15 and wrapped around the handle of the dumbbell to attach the handle 5 thereto. It should also be appreciated by those skilled in the art that the hook and loop cinch strap attachment device 40 may be threaded through the aperture 20 on the handle 5 embodiments not having a passageway 60, as shown in FIG. 7. Although shown as a hook and loop strap, one of skill in the art would appreciate that any attachment device 40 used may be threaded through the aperture 20 as shown in FIG. 7.

While certain embodiments of the present invention are described in detail above, the scope of the invention is not to be considered limited by such disclosure, and modifications are possible without departing from the spirit of the invention as evidenced by the following claims:

What is claimed is:

1. A dumbbell attachment, comprising:

a handle, said handle including:

a base portion, said base portion having a contact surface;

a grip portion defining an aperture, said grip portion including a pair of side grips and a top grip, said side grips extending from said base portion and terminating at said top grip; and an attachment device in association with said base portion, said attachment device threaded through said aperture and around a dumbbell handle, wherein said attachment device immovably secures said handle to said dumbbell handle a textured pad interposed between said contact surface and said dumbbell handle, said pad curved so as to complimentary engage with said dumbbell handle.

2. The dumbbell attachment of claim 1, wherein said pair of side grips and said top grip have a diameter ranging from about 1.25 inches to about 2.25 inches.

3. The dumbbell attachment of claim 1, wherein said attachment device is selected from a group consisting of: hook and loop straps, ratchet straps and combinations thereof.

* * * * *